US005839482A

United States Patent [19]

Vestby et al.

[11] Patent Number: 5,839,482

[45] Date of Patent: Nov. 24, 1998

[54] ELECTRO-PNEUMATIC LOOM SHEDDING SYSTEM

[75] Inventors: Vibeke Vestby, Røyse; Petter Muren, Kolsås; Ole Christian Tronrud, Sokna, all of Norway

[73] Assignee: Digital Weaving Norway AS, Royse, Norway

[21] Appl. No.: 860,710

[22] PCT Filed: Jan. 23, 1995

[86] PCT No.: PCT/NO95/00017

§ 371 Date: Jul. 18, 1997

§ 102(e) Date: Jul. 18, 1997

[87] PCT Pub. No.: WO96/23092

PCT Pub. Date: Aug. 1, 1996

[30] Foreign Application Priority Data

Nov. 26, 1993 [NO] Norway ..... 934278

[51] Int. Cl.[6] ..... D03C 3/22; D03C 13/00; D03D 29/00

[52] U.S. Cl. ..... 139/456; 139/29; 364/470.02

[58] Field of Search ..... 139/456, 29; 364/470.02, 364/470.08, 470.11; 137/595, 870, 909, 624.18

[56] References Cited

U.S. PATENT DOCUMENTS

| | | | |
|---|---|---|---|
| 572,246 | 12/1896 | Cuscaden et al. | 139/456 |
| 2,558,284 | 6/1951 | Whitaker | 139/55 |
| 3,224,465 | 12/1965 | Fontaine | 139/12 |
| 4,195,671 | 4/1980 | Bossut | 139/456 |
| 5,390,709 | 2/1995 | Martonffy | 139/456 |
| 5,494,080 | 2/1996 | Sano | 139/456 |
| 5,762,112 | 6/1998 | Feer | 139/456 |

FOREIGN PATENT DOCUMENTS

| | | |
|---|---|---|
| 934278 | 5/1995 | Norway . |
| 1482640 | 8/1977 | United Kingdom . |

*Primary Examiner*—Andy Falik
*Attorney, Agent, or Firm*—Merchant, Gould, Smith, Edell, Welter & Schmidt

[57] ABSTRACT

A manual loom can be complemented by a device which makes possible computer-controlled weaving even in such simple looms. The device comprises a PC, a printed board control and a module block having air cylinders with appurtenant pistons which bear the weighted lifting rods for the warp threads.

3 Claims, 4 Drawing Sheets

ELECTRO-PNEUMATIC LOOM SHEDDING SYSTEM

FIELD OF THE INVENTION

The invention relates to a device for use in a loom for raising warp threads in accordance with a desired weave pattern by means of weighted lifting rods.

BACKGROUND OF THE INVENTION

Industrial looms have undergone rapid development, from the introduction of punched card control to today's machines, which, in step with the general trend within electronics and computer technique, have evolved into fully electronic, computer-controlled machines. The state of the art of today's computer design systems makes it possible inter alia to control data media for electronic Jacquard machines as well as to control a large number of electronic Jacquard machines via a network computer, and also makes it possible, of course, to develop and process Jacquard designs as desired.

SUMMARY OF THE INVENTION

It is an objective of the present invention to make possible the use of computer technique in a simple and inexpensive manner also for manual or hand looms. The term "manual looms" is used to mean looms of the type found in homes, the type used by interested amateurs and also by craftspersons, i.e., looms which on the whole are intended for the production of individual items. Looms of this kind have a relative simple structure, and the pre-setting of the loom for desired raising (shedding) of the warp threads in accordance with a desired weave pattern, is relatively time-consuming, although today there are suitable punched card systems, and systems based on computer technique, so that the weaver can produce virtually all possible designs in the weave—designs which can be drawn according to need on a PC screen.

The easiest way to implement the invention is to use a cylinder/piston module with single top valves, controlled by respective superjacent solenoids. The module is realised most easily as a cylinder block of an appropriate material, where a desired number of parallel cylinders are drilled out, in which a respective piston with attached lifting rod is placed. A common chamber is provided above this cylinder block where the solenoids are located, above their respective valves. This common chamber can be put under negative pressure or positive pressure. Atmospheric pressure acts on the underside of the respective pistons and actuates these in an upward direction. When a piston ascends it will take a warp thread with it. Which valves are to be opened is determined by the design drawn on the PC screen, via printed card control which activates the appropriate solenoids. As soon as the weft is finished, the pistons are caused to descend into the starting position. Thus, the cycle continues.

Several modules can be arranged one after the other, laterally or in the longitudinal direction of the loom, thereby covering a larger area, with the possibility of weaving everything from narrow bands to wide woven cloths, up to the maximum width of the loom.

The new device is simple, inexpensive and can be adapted readily to an ordinary simple loom.

BRIEF DESCRIPTION OF THE DRAWINGS

The invention will now be described in more detail with reference to the drawings, wherein.

DETAILED DESCRIPTION OF THE DRAWINGS

Figure 1:
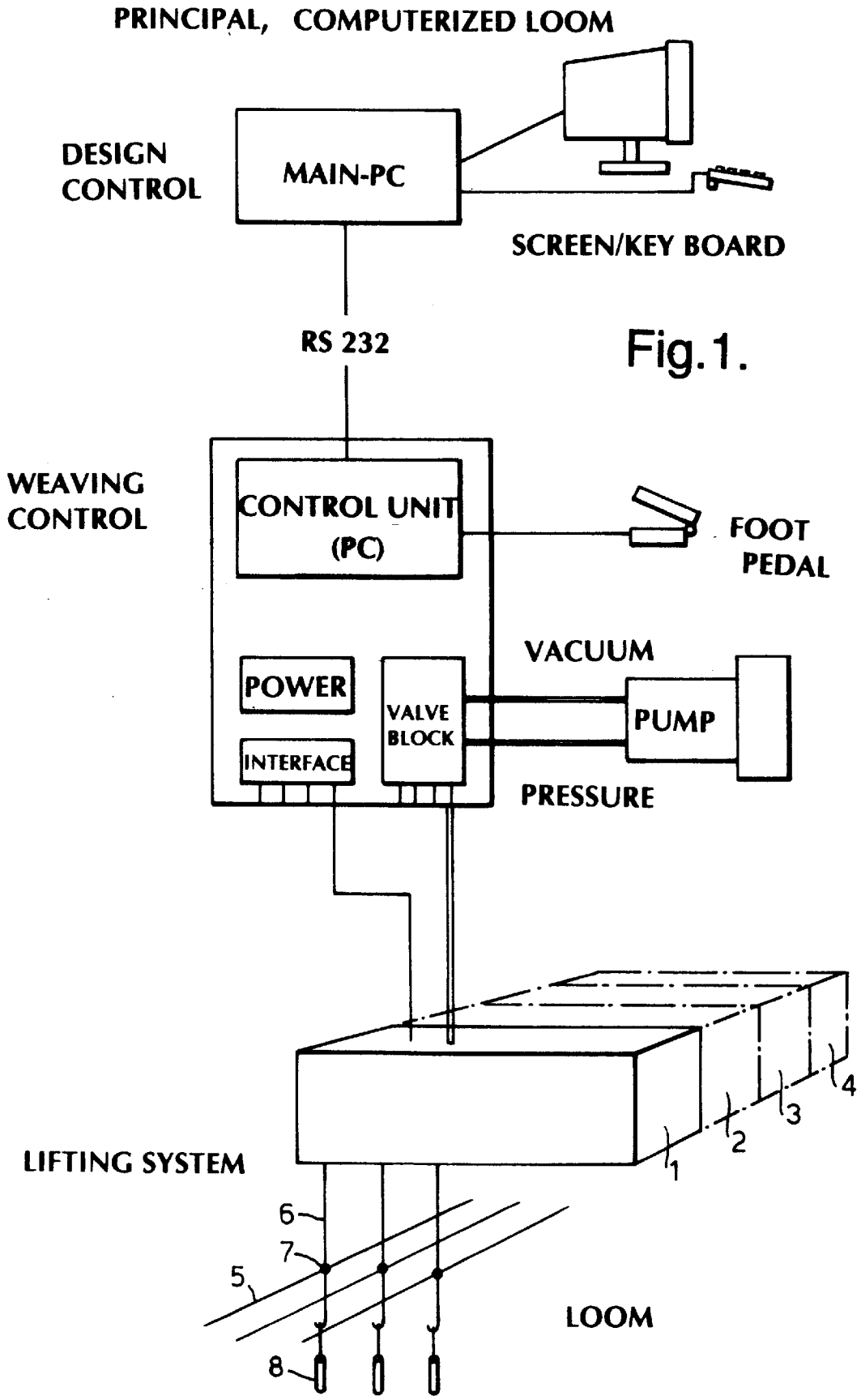
FIG. 1 is a skeleton diagram of a computerised loom.

FIG. 1 illustrates the principle of a computerized loom device where the invention can be used. A design control, a weave control and a lifting system are all to be found in the figure.

Figure 3:
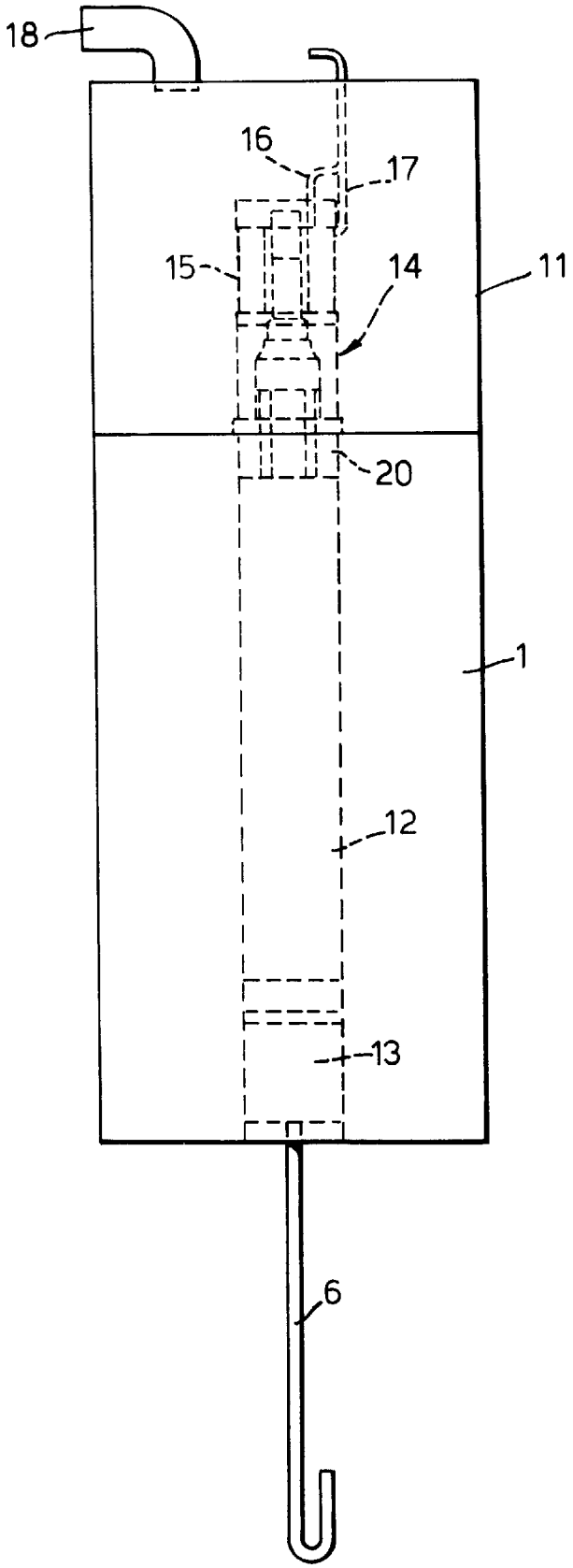
FIG. 3 is a simplified section through a module.

The design control is in reality a PC, while the weave control comprises a printed card control and a necessary pump for the provision of negative and positive pressure. The lifting system comprises a cylinder block. In practice, the cylinder block and the valve block will be constructed as one, as can be seen in FIG. 3. In addition, reference is made to the explanatory text in FIG. 1.

In FIG. 1 a cylinder block 1 is shown. The broken lines indicate how additional similar blocks 2,3 and 4 can be juxtaposed with the block in the warp direction, as determined by the warp threads 5. The individual blocks or modules can also be placed side by side, that is transverse to the warp direction.

In each block 1 there is a plurality of cylinders with appurtenant pistons, and these pistons in turn are attached to respective lifting rods 6. Each such lifting rod has in a known way a warp thread eyelet 7 and is weighted with a suitable weight 8.

Figure 2:
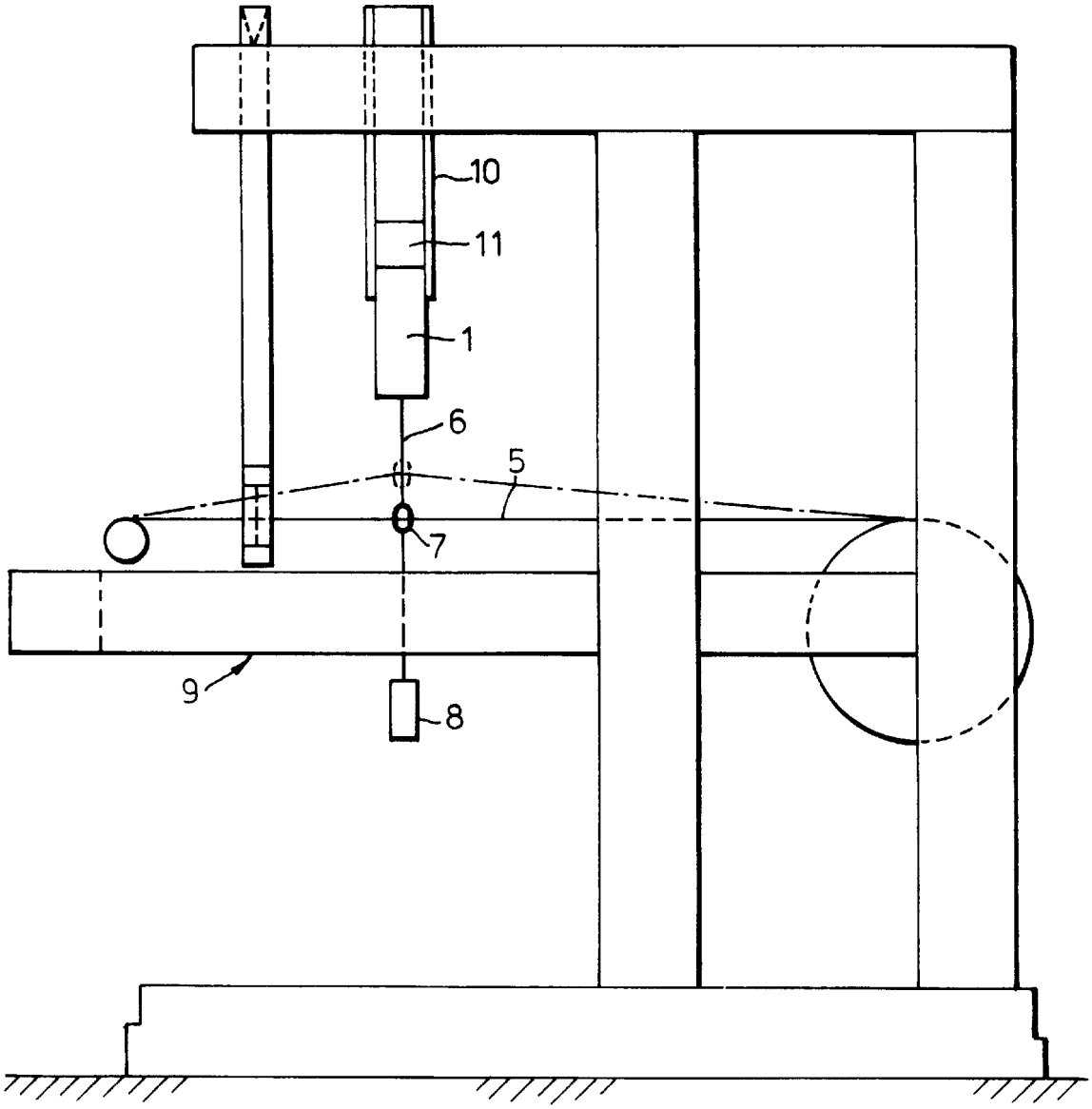
FIG. 2 is a simplified outline of a loom where the invention is used.

FIG. 2 is a simplified side view of a loom 9. The warp threads are indicated by means of the reference numeral 5. Each warp thread is attached to a lifting rod 6 in that the thread is threaded through an eyelet 7 in the lifting rod. The lifting rod 6 bears a weight 8. The lifting rod 6 ascends in a cylinder block 1. This cylinder block 1 is suspended in the loom by means of a suitable supporting stay 10. On the top of the cylinder block 1 is a common chamber 11. This housing forms a common chamber for the cylinders in the cylinder block.

FIG. 3 is a schematic section through the block 1 with appurtenant common chamber 11. The block and the common chamber together form a module which may contain a desired number of cylinders. In the drawings, the module is shown having a single row of laterally placed cylinders, but a module can, of course, contain several parallel rows of cylinders, for example, three times 20 cylinders.

In the schematic section in FIG. 3, it can be seen that the cylinder block 1 has a through-going cylinder 12. In the cylinder 12 there is placed a piston 13 with a downwardly projecting lifting rod 6.

A common chamber 11 is provided on the top of the cylinder block 1. A plurality of solenoid-operated valves 14 are placed herein, one for each cylinder 12. Electric current is supplied to the winding 15 of the solenoid through the electric leads 16,17. The common chamber 11 is connected to a pump device through the indicated connecting pipe 18.

Figure 4:
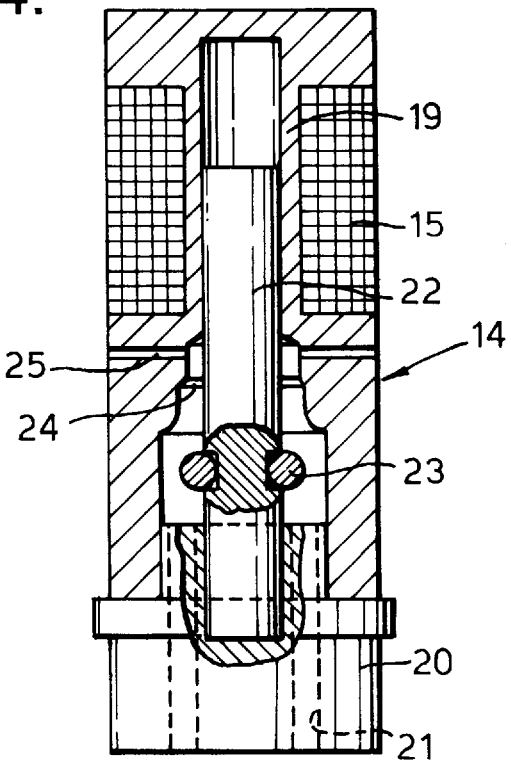
FIGS. 4 and 5 show enlarged sections through a preferred solenoid valve, in an open and closed position, respectively.
Figure 5:
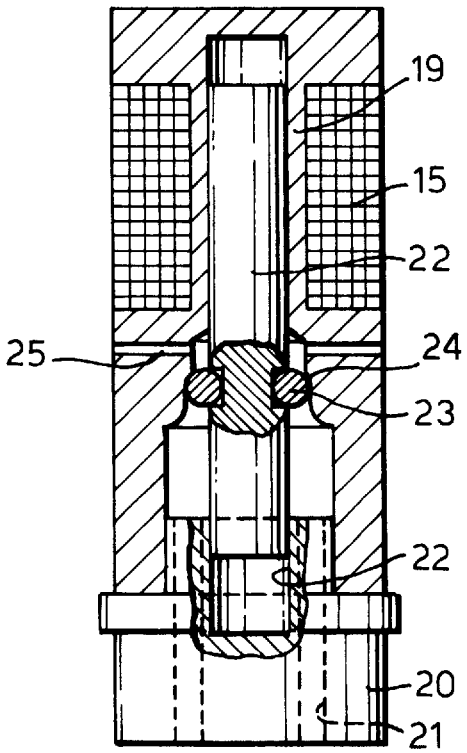

The solenoid-operated valve is shown on a larger scale in FIGS. 4 and 5. The valve 14 is constructed having a housing body which comprises the solenoid core 19 with appurtenant winding 15. The housing body is on an intermediary 20, which is designed for insertion into the upper open end of the cylinder, see FIG. 3. There are holes 21 for the passage of air to the cylinder 12 in the intermediary 20. There is a blind bore 22 (see FIG. 5) in the intermediary 20 wherein the armature or valve stem 22 passes. The valve stem 22 has an annular groove wherein an 'O' ring 23 is placed. The said 'O' ring is located inside the interior of the housing body, wherein above the 'O'ring there is a valve seat 24. Holes 25 for the passage of air are provided immediately above the valve seat 24.

In FIG. 4 the valve is shown in a no-current state and it is open, the 'O' ring 23 being spaced apart from the valve seat 24. In FIG. 5 the armature or valve stem has been drawn in as a result of the solenoid having received an electric pulse, and the 'O' ring 23 now rests in a sealing fashion against the valve seat 24. The valve is closed.

The thread control functions in the following manner. As mentioned, the valve 14 is located on the top of a respective cylinder 12. The valve is in a common chamber which is connected to a pump device, see FIG. 1. In the individual cylinder 12 there is a piston 13 which is connected to a thread in the loom by means of the lifting rod 6. When the valve is open and the common chamber is put under negative pressure, the air will be drawn out of the cylinder and will draw the piston 13 up. The underside of the piston is actuated by atmospheric pressure.

In a module a great number of valves and cylinders are mounted or formed side by side in a block. All the valves can be operated independent of one another.

If a piston 13 is to be down while the others are raised, the following happens:

Slight negative pressure is applied in the common chamber 11, but not sufficient to cause the piston to be raised.

The control system sends an electric pulse to the valve 14.

The armature or valve stem 22 is raised.

The 'O' ring 23 on the valve stem 22 will seal against the valve seat 24.

The negative pressure above the 'O' ring 23 causes the valve stem to be held up, even after the solenoid or electromagnet has stopped working.

The pressure on the underside of the valve stem will be approximately atmospheric pressure owing to a small leakage between the piston and the cylinder.

When a greater negative pressure is applied (lifting negative pressure), the piston in question will remain down whilst the others are raised.

To re-set the system, positive pressure is applied in the common chamber 11, the valve stem 22 will fall down and the valves 14 are opened.

We claim:

1. A shedding apparatus for being fitted onto a loom for controlling up and down movement of warp-carrying lifting rods to form a filling insertion shed, said apparatus comprising:

a cylinder block having an upper and lower end face and a plurality of throughgoing cylinder bores extending between said faces;

a piston in each cylinder bore, said pistons having an upper end face and a lower end face and carrying a weighted lifting rod extending down from said cylinder block;

a common air chamber on top of said cylinder block, said common air chamber having a plurality of openings towards and corresponding to said cylinder bores;

a solenoid-operated valve in each of said openings on top of each cylinder bore; and means for providing negative and positive pressure in said common air chamber, wherein said solenoid-operated valve comprises a valve housing, an internal valve chamber in said valve housing, a valve seat in said valve chamber dividing said valve chamber in an upper and lower part, said lower part being in open communication with the corresponding cylinder bore, a valve member in said lower part of the valve chamber, a solenoid on top of said valve housing, said solenoid having an armature stem extending into the valve chamber and being connected to said valve member, and an open communication between said upper part of the valve chamber and said common chamber, such that atmospheric pressure will act on the pistons on their lower ends, said pistons being arranged to leak air between said upper and lower piston end faces.

2. The apparatus of claim 1, wherein said valve member comprises an O-ring and said valve seat is circular and adapted for sealing cooperation with said O-ring.

3. The apparatus of claim 1, wherein the solenoid is in one piece with the valve housing.

* * * * *